US005873273A

United States Patent [19]

Vick

[11] Patent Number: 5,873,273

[45] Date of Patent: Feb. 23, 1999

[54] DOOR LOCK DEVICE

[76] Inventor: Gregory Louis Vick, 314 Partridge, Houston, Tex. 77060

[21] Appl. No.: 713,023

[22] Filed: Sep. 12, 1996

[51] Int. Cl.[6] ..... E05B 65/06

[52] U.S. Cl. ..... 70/101; 70/94; 292/259 R

[58] Field of Search ..... 70/94, 101, 14, 70/158–173, 57, 58; 292/259 R, 288, 289, 338, 339

[56] References Cited

U.S. PATENT DOCUMENTS

| | | | |
|---|---|---|---|
| 1,748,598 | 2/1930 | Dermody | 70/101 X |
| 2,301,810 | 11/1942 | Phillips | 70/94 X |
| 2,421,275 | 5/1947 | Lopez | 292/259 |
| 2,693,691 | 11/1954 | Pasanen | 70/58 |
| 3,592,497 | 7/1971 | Logan, Jr. | 292/259 |
| 3,980,328 | 9/1976 | Pearson | 292/259 R X |
| 4,067,598 | 1/1978 | Mansour | 292/259 R |
| 4,078,836 | 3/1978 | Wilson | 292/259 R |
| 4,082,332 | 4/1978 | Palmer | 292/259 R |
| 4,135,376 | 1/1979 | Evans et al. | 70/94 X |
| 4,348,879 | 9/1982 | Knierim | 70/93 |
| 4,413,852 | 11/1983 | Burnell et al. | 292/259 R |
| 4,673,203 | 6/1987 | Chezem | 292/339 |
| 4,676,536 | 6/1987 | Arbic et al. | 292/339 |
| 5,014,527 | 5/1991 | Traller et al. | 70/94 |
| 5,102,173 | 4/1992 | Schallern | 292/288 |
| 5,163,308 | 11/1992 | Lillo | 70/51 |
| 5,165,741 | 11/1992 | Everett | 292/259 R |
| 5,199,759 | 4/1993 | Anderson | 292/288 |
| 5,282,656 | 2/1994 | Fizer | 292/259 R |
| 5,435,102 | 7/1995 | McCarthy | 49/365 |
| 5,605,364 | 2/1997 | Shelledy | 292/259 R |

FOREIGN PATENT DOCUMENTS

| | | | |
|---|---|---|---|
| 445856 | 9/1991 | European Pat. Off. | 70/94 |

*Primary Examiner*—Suzanne Dino Barrett

*Attorney, Agent, or Firm*—Vaden, Eickenroht & Thompson, L.L.P.

[57] ABSTRACT

An apparatus for preventing a door from opening. The apparatus preferably comprises a pair of anchors which are mounted to a floor. The anchors are located beyond both edges of the door on the side toward which the door opens. Each of the anchors has a slot in it so that it can accept an end of a cross bar to form a connection. The anchors are oriented so that the slot in each anchor aligns with the slot in the other anchor when the door is in a closed position and the apparatus is engaged. A cross bar is placed between the anchors to prevent the door from opening. The cross bar is connected to the anchor on the edge of the door which is on the same edge of the door as the hinge of the door by a pin which allows the cross bar to be rotated upwardly. The anchor with the hinge is connected to the floor in such a manner as to allow the anchor to rotate on an axis which is perpendicular to the floor. This rotation allows the cross bar to swing with the door when the cross bar is disengaged from the floor anchor nearest to the opening edge of the door. The cross bar can be disengaged from the anchor nearest to the opening edge of the door by being lifted upwardly by means of linkages connecting the cross bar to a locking device which can be operated either from the inside or from the outside of the door.

25 Claims, 2 Drawing Sheets

FIG. 1
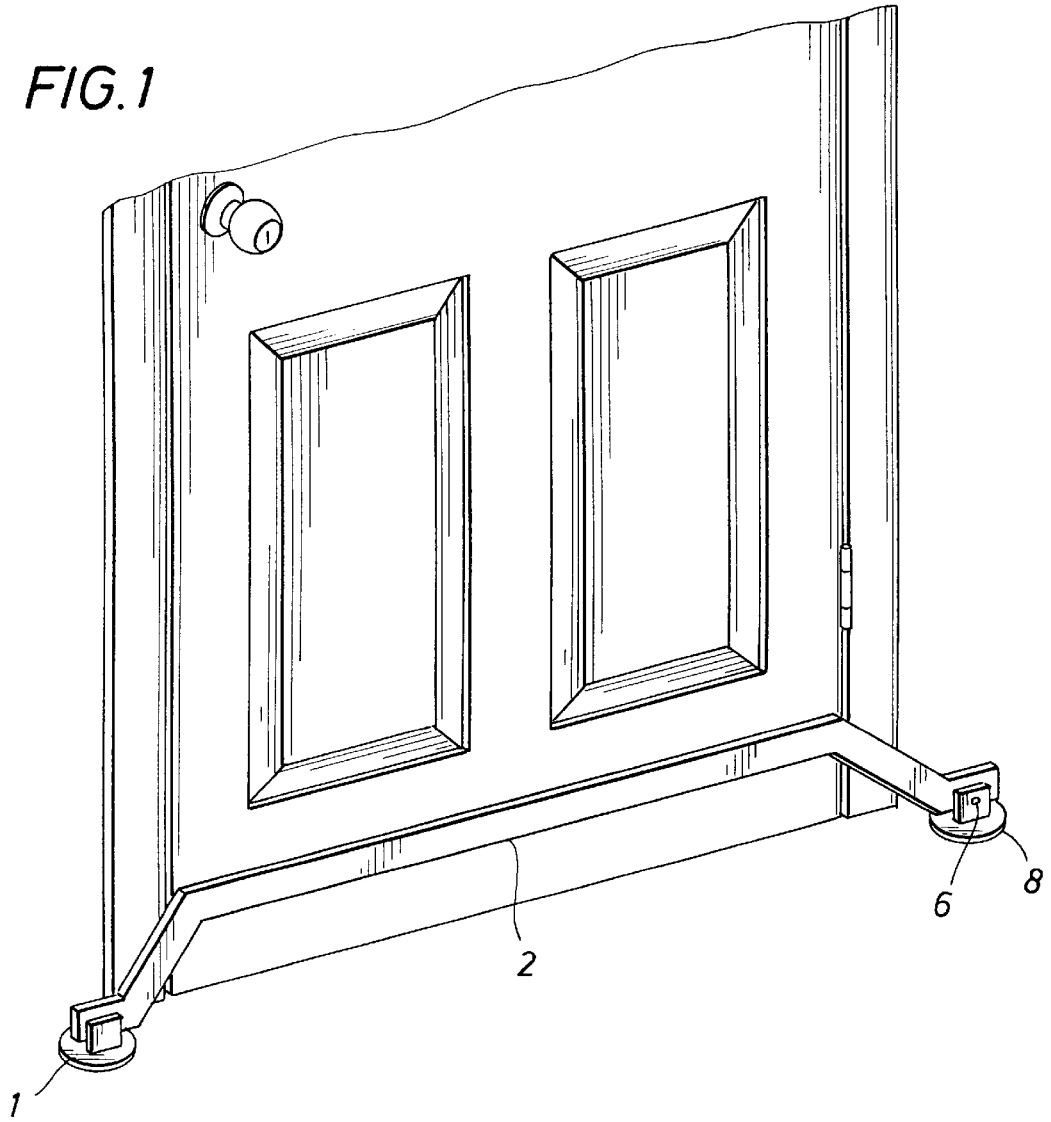
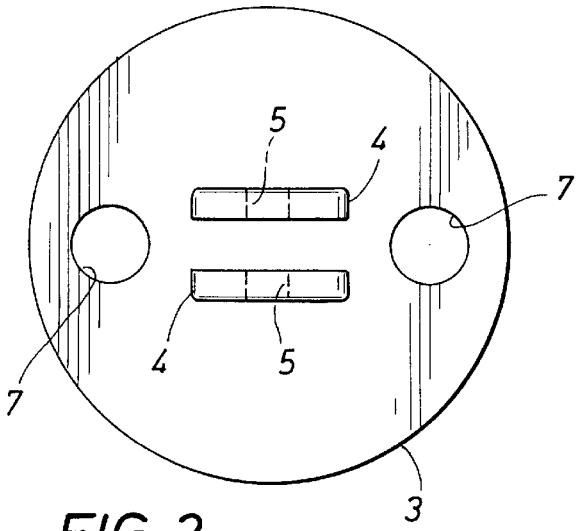
FIG. 2
FIG. 3
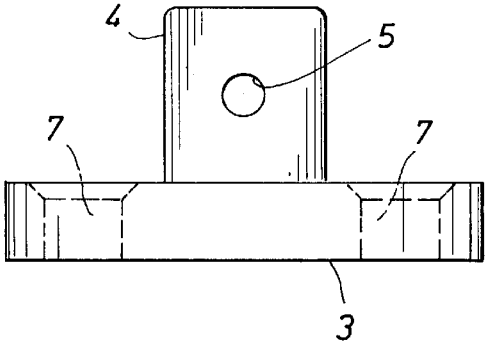

FIG. 4
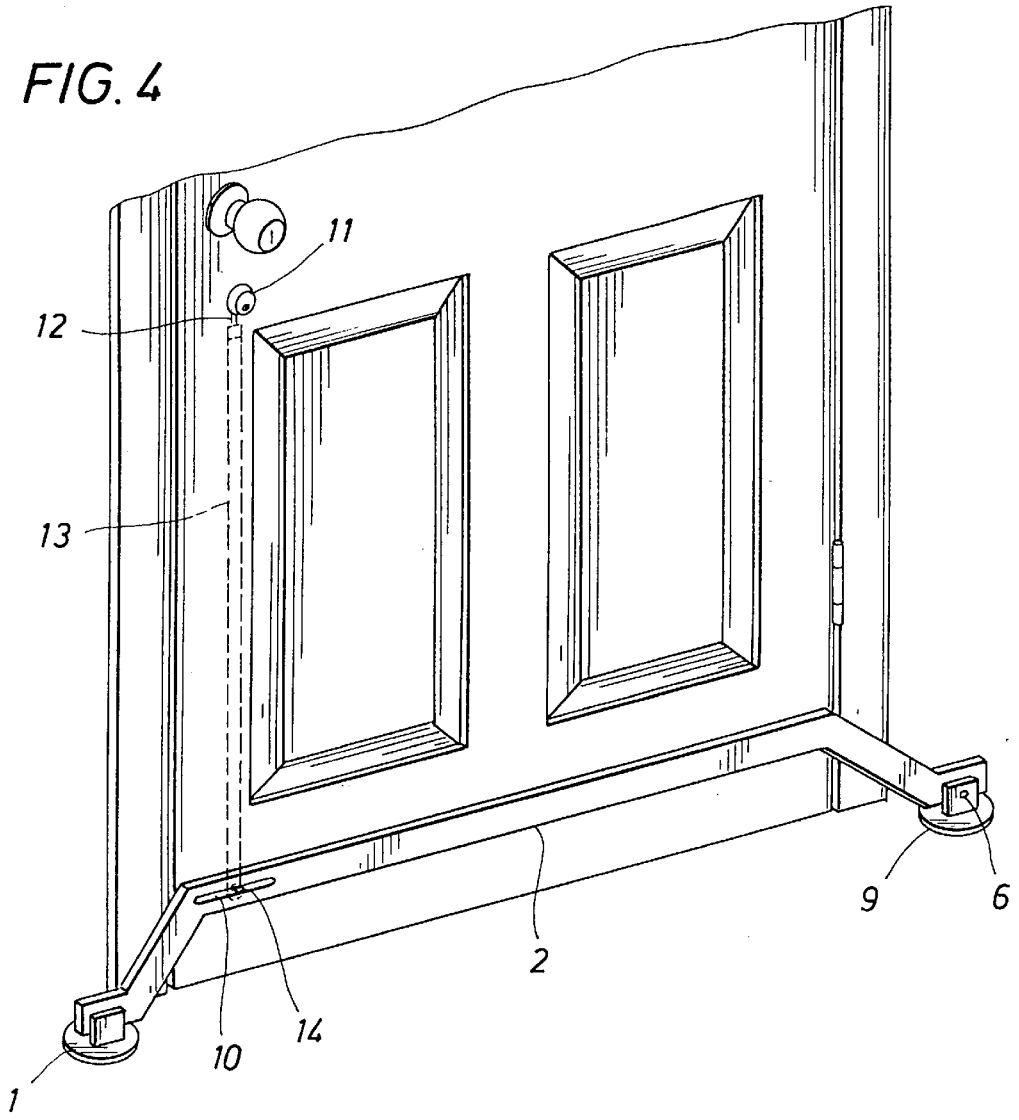
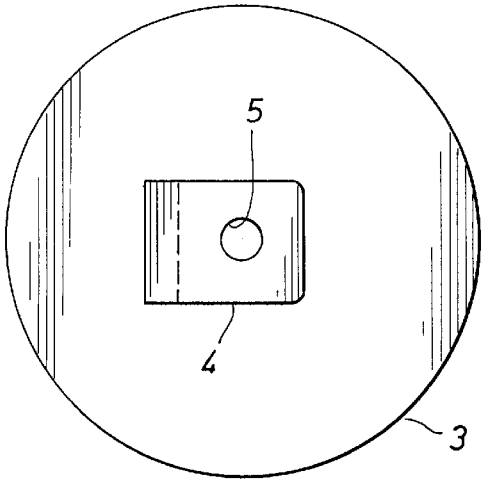
FIG. 5
FIG. 6
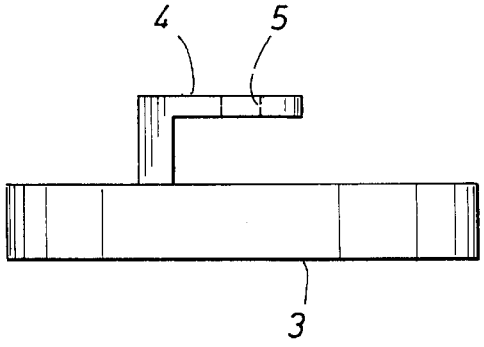

DOOR LOCK DEVICE

BACKGROUND OF THE INVENTION

This invention relates to the securing of doors, specifically to the securing of a door with an apparatus that utilizes the securing strength available through connection to the floor, but without leaving parts of the securing apparatus in the pathway of the door.

Forced entry through doors supposedly designed to provide privacy and security to occupants behind the doors is a problem that has long been worrisome to occupants. Simple knobs can only serve to prevent a person from entering who is not willing to turn the knob and enter. A locking device that prevents the knob from turning when locked is an answer to that problem. Forcefully entering any locked door is, however, only limited by the amount of force a person trying to enter is willing to apply to the door. The purpose of an apparatus designed to secure a door is to make the force required to enter a locked door greater than is practically available to a perpetrator. A method of forcing open a door would not be practically available if it was either physically beyond the capability of a perpetrator or demanded adequate time and energy for the perpetrator to be discovered by the authorities.

As a failure mechanism, a door assembly may yield through three main modes. First, the door itself may rupture. Most doors are significant enough that if adequate force is applied to the door to rupture the door, there will be a great deal of noise associated. U.S. Pat. No. 5,154,461 provides a bar along the middle section of a door that it claims would strengthen that portion of the door. That invention claims that such a strengthening would be especially significant in adding support to "hollow-core" doors. That claim does seem reasonable, but hollow-core doors are typically not used where security is a main function of the door. Even where such a door might be used for security, destruction of the hollow-core door by brute force would create a significant disturbance and would be likely to require greater force than other means of entry.

The second failure mode would be for the door latch bolt or hinges to fail. Shearing of the bolt or hinges is very unlikely because of the relative strengths of the metal of which the bolt or hinge is made compared to the wood to which the bolt or hinge is typically connected. If the door jam were constructed of metal, a determination of where the failure would occur would be a closer question. With all metal construction, however, the force required to force open the door would be quite significant and would be likely to be beyond the capability of most perpetrators. Those that could force entry would be more noticeable in their efforts. Very little in the prior art is directed to the strengthening of the door latch bolt or the hinge pins. This is logical since the bolt and hinges connect directly to the weakest link in the door locking mechanism.

The weakest link in the door locking mechanism is the door jamb at the latch bolt. This, along with tear-out of the connection devices that hold the hinges in place, is the third mode of failure. Failure at the latch bolt is more likely than failure at the hinges because the hinges are far apart, typically have more connectors, and would be hard to strike simultaneously. It is evident why a door jamb in a residence is likely to be the typical failure element when the jamb's characteristics are considered. The typical residential door jamb is constructed of wood. The wood is oriented such that a force applied to the door latch bolt will be transferred to the wood perpendicular to the grain of the wood and relatively near to the edge of the wood. Wood has very poor tensile strength perpendicular to the grain. Therefore, when relatively little force is applied to the jamb through the latch bolt, the jamb is split and the door swings open. U.S. Pat. Nos. 5,154,461 and 5,199,759 both recognize this problem specifically. The '461 patent attempts to strengthen the connection at the jamb by putting more and longer screws into the jamb through the striker plate to which the latch bolt connects. This must help some, but only provides limited additional strength since the wood in the jamb or a stud behind the jamb is still being loaded in tension perpendicular to the grain.

The '759 patent approaches the problem in a different way. Because of the limitations of the jamb, this patent looks for strength from the floor to provide security. The floor is essentially an enormous plate held in place by the weight of the building. If a secure connection can be made to the floor, a door can be held firmly in place. The '759 patent as well as U.S. Pat. Nos. 4,348,879, 4,673,203, 4,676,536, and 5,163,308 all rely on this principle to secure doors. Each of these, however, is limited in ways the present invention is not.

The '203 and '536 patents rely on jamming a member at an acute angle between the door and the floor. Such a member is, however, subject to slippage along the floor. The '879 and '308 patents require recesses to be created in the floor. This creates a problem because the recesses tend to fill up with dirt. The recesses tend to fill up because they are below a pathway. Such devices become inoperable unless they are cleaned out regularly. The '759 patent is not limited by either of these problems, but does create a practical problem. The anchor piece listed in each of its embodiments must be in the pathway of the door. Consequently, it must also be in the pathway of the persons using the door. The anchor piece is a tripping hazard. Further, in the second embodiment, the door sill anchors the wedge that holds the door. The sill is visible from the other side of the door and is subject to being manipulated from the outside.

Of all of the prior patents listed above, only the '461 patent allows for operation from outside of the building. This means that unless the occupants are inside the building, or leave the building from some other exit, the security of the supplementary device cannot be utilized. If the occupants were to leave by some other exit that did not have a supplementary security device, it is likely that the other exit could be manipulated for entry and thus the security of the supplementary device would be defeated. Though the '461 patent does provide operation from outside of the building, it does not connect to the floor and is therefore limited in strength by the strength of the door jamb. The present invention can be configured to operate from outside of the building through a locking device and linkages which can engage and disengage the cross bar.

It is therefore an object of the present invention to provide an apparatus for securing a door which is connected directly to the floor.

It is further an object of the present invention to provide an apparatus for securing a door which is located above floor level and requires little or no maintenance.

It is further an object of the present invention to provide an apparatus for securing a door which is outside of the pathway unless the door is in the secured position.

It is further an object of the present invention to provide an apparatus for securing a door which is beyond the reach of manipulation from the other side of the door.

It is further an object of the present invention to provide an apparatus for securing a door which can be operated from either side of the door and thus allows for use of the securing device when a building is not occupied.

SUMMARY OF THE INVENTION

These and other objects are achieved by the present invention. The present invention is an apparatus for preventing a door from opening comprising one or more and preferably a pair of anchors and a cross bar that connects to the anchors and blocks the movement of the door. Each of the anchors is placed beyond the edges of the door opening so that the anchors will not obstruct the pathway of travel of the door or the pedestrian pathway. The anchors are located on the side of the door toward which the opening of the door is being restricted. Each of the anchors is composed of a base plate and one or more keeper plates. The keeper plates are oriented perpendicular to the base plate and equidistant from one another to form a slot perpendicular to the base plate. The anchors are oriented on the floor such that the slots are aligned with one another.

The cross bar is of a length greater than the width of the door. The ends of the cross bar are placed in the slots formed by the anchors. When the cross bar is in place, it obstructs the pathway of the door. Where the anchors and bar are positioned to contact the door when the door is in a closed position, the apparatus will act in conjunction with the door's other locking devices to secure the door.

Alternatively a single keeper plate in each anchor may be connected to but spaced apart from the base plate, said keeper plate being parallel to the base plate such that a slot is formed between the base plate and the keeper plate and perpendicular to the opening of the door. In this embodiment, the cross bar may be hingedly attached to one of the anchors and attached to the other anchor by means of a removable pin. Alternatively, the cross bar may be rigidly attached to one of the anchors, said first anchor being rotatably attached to the floor, and attached to a second anchor by means of a removable pin. In either of these configurations, when the removable pin on the second anchor is not in place, the cross bar would be permitted rotatable movement in a horizontal direction generally in line with the horizontal rotation of the door when the door is opened or closed.

In yet another alternative, the cross bar is placed between the door and one or more anchors without being pinned to the anchor. In this embodiment, the keeper plate that is part of the anchor may be either singular, with a slot being created by the keeper plate and the wall or doorjamb near the door or there may be a plurality of keeper plates creating one or more slots to allow adjustment of how tightly the door is held and hence whether the door may be slightly ajar without releasing the securing mechanism. Further, the keeper plate may be parallel to the base plate such that a slot is formed between the base plate and the keeper plate and perpendicular to the opening of the door. When such a generally horizontal keeper plate is used, the portion of the anchor attaching the based plate to the keeper plate should be aligned furthest from the door such that the opening to the slot is between the door and the anchor.

In a preferred embodiment of the present invention, the anchor located nearest to the hinged edge of the door is connected to the cross bar by a pin extending through the cross bar and the keeper plates of the anchor. This connection forms a hinge that enables the cross bar to be rotated upwardly about the pin. When the cross bar is rotated upwardly, the pathway of the door is cleared. In the upwardly rotated position the cross bar is not only out of the pathway of the door, but is also conveniently stored behind the door.

In another preferred embodiment of the present invention, both anchors can be connected to the cross bar by respective pins extending through the cross bar and through the keeper plates of the anchors. The anchor located nearest to the hinged edge of the door can be equipped with a pin so that the cross bar may be rotated upwardly to a storage position outside of the pathway of the door. The anchor located on the opposite edge of the door can be equipped with a removable pin in order to fix the cross bar in a down and locked position when the pin is engaged. When the pin is disengaged the cross bar would be free to rotate.

In another preferred embodiment of the present invention, the anchors can be connected to the floor by use of one or more bolts or screws. The base plate of the anchor may be machined to allow the bolts or screws to be counter sunk, and therefore to be flush with the top of the base plate. As an alternate means of connection, the anchors could be embedded into the flooring material at the time of construction of the floor or at a later by various means of embedding.

In another preferred embodiment of the present invention, the anchors can be set approximately three inches behind the door. This placement would allow for the cross bar to act as a safety device which would allow for the door to be opened enough for the person inside to look out of the opening to see who was requesting entry.

In another preferred embodiment of the present invention, the crossbar is curved or set at angles and the anchors are set at a distance behind the door that allows the crossbar to be in contact with the closed door when the bar is in place across the anchors.

In another preferred embodiment of the present invention, the anchor beyond the edge of the door nearest to the hinge of the door can be rotatably connected to the floor. A cross bar having a slot parallel to the longitudinal axis of the cross bar is connected to the anchor which is nearest the edge of the door which is on the same edge of the door as the hinge of the door by a pin extending through the cross bar and through the keeper plates of the anchor. Therefore, the cross bar is free to rotate upwardly as well as swing open parallel with the door as the door is opened. When the door is in a closed position, the cross bar is raised from or lowered into the anchor located nearest to the opening edge of the door by a linkage from the cross bar to a locking device which can be operated from either inside or outside of the door. The linkage is connected to the cross bar by a connecting pin providing a means for slidably engaging the slot in the cross bar. A hanger bar provides a fixed connection to the connecting pin, and the upper end of the hanger bar is connected to a lock linkage through a rotatable connection. The lock linkage is fixed to the locking device. When the locking device is rotated from either inside or outside of the door, the linkages work in concert to raise and lower the cross bar. The raised cross bar is disengaged from the anchor nearest to the opening edge of the door. When the cross bar is lowered, it engages the anchor to secure the door.

BRIEF DESCRIPTION OF THE DRAWINGS

In the following drawings, like reference characters are used to describe like parts:

FIG. 1 is an isometric view of a preferred embodiment of the present invention in place behind a closed door.

FIG. 2 is a plan view of an anchor according to the present invention.

FIG. 3 is an elevation view of an anchor according to the present invention.

FIG. 4 is an isometric view of a preferred embodiment of the present invention in place behind a closed door, including a lock and linkages.

FIG. 5 is a plan view of another embodiment of an anchor according to the present invention.

FIG. 6 is an elevation view of another embodiment of an anchor according to the present invention.

DETAILED DESCRIPTION OF THE PREFERRED EMBODIMENT

A preferred embodiment of the present invention is shown in FIG. 1 engaging a door that is in the closed position. The cross bar 2 is inserted into anchors 1 and 8 to prevent the door from opening.. Anchor 8 is an anchor which is rotatably connected to the cross bar 2 by a pin 6. Anchor 8 is shown beyond the edge of the door which is on the same edge as the hinge of the door or eliminated altogether. Anchor 1 is an anchor into which cross bar 2 has been inserted. Because cross bar 2 has been connected to anchors 1 and 8, and because cross bar 2 is in contact with the door, the door is prevented from opening. Cross bar 2 is a rigid bar which is approximately one quarter of an inch wide and is long enough to engage the anchors beyond both edges of the door. The length of cross bar 2 will vary depending on the width of the door being secured. In other embodiments of the present invention, an anchor 1 could be located beyond the edge of the door which is on the same edge as the hinge of the door or eliminated altogether. Also, an anchor with a pin similar to pin 6 in anchor 8 could be located beyond the edge of the door which is on the opposite edge as the hinge of the door. If a pinned connections were used for both anchors simultaneously, at least one of the pins should be removable so that the bar could be rotated beyond the pathway of the door.

FIGS. 2 & 3 depict the plan and elevation views of the preferred embodiment of an anchor 8. Means is provided for connecting keeper plates 4 to base plate 3. In the preferred embodiment, keeper plates 4 are welded to base plate 3. However, as would be evident to a person skilled in the art, another means of connecting the pieces would be equivalent. It would also be evident to a person skilled in the art that, although the keeper plates are rectangular plates in the preferred embodiment, the same function could be provided by pieces of various shapes when positioned similarly to the preferred embodiment.

When bolts or screws are used to secure an anchor to the floor, holes 7 must be created in base plate 3. As shown in FIG. 3, base plate 3 can be machined to allow the bolts or screws to be counter sunk. Alternatively, a fixed bold could be set into the bottom of the plate 3. Alternatively, a recess could be included in the bottom of plate 3 to allow attachment to a blot or other protrusion set in the floor. The base plate 3 is round in the preferred embodiment, but it would be evident to a person skilled in the art that the base plate could be of various shapes and provide the same function.

When pins are used, whether fixed or removable, to connect an anchor to the cross bar 2, holes 5 must be created in the keeper plates 4 as well as the cross bar 2.

A preferred embodiment of the invention is shown in FIG. 4 in place behind a door that is in the closed position. The cross bar 2 is inserted into anchors 1 and 9 to prevent the door from opening. Anchor 9 is an anchor which is rotatably connected to the cross bar 2 by a pin 6 and rotatably connected to the floor about its axis which is perpendicular to the floor. Anchor 1 is an anchor into which cross bar 2 has been inserted. Cross bar 2 is a rigid bar which is approximately one quarter of an inch wide and is long enough to engage the anchors beyond both edges of the door. Cross bar 2 is milled to have a slot 10 which is long enough to allow connecting pin 14 to remain slidably engaged in cross bar 2 when the door is rotated about its hinges. The slot is necessary because the radii of rotation of the door about its hinges and cross bar 2 about anchor 9 are not equal. When the door is in the closed position, cross bar 2 may be raised from or lowered into anchor 1 by rotating locking device 11. Locking device 11 extends through the door and provides a means to rotate a lock mechanism from either side of the door. Locking device 11 is fixedly connected to lock linkage 12. Lock linkage 12 is rotatably connected to hanger bar 13. Hanger bar 13 is fixedly connected to connecting pin 14. Connecting pin 14 slidably engages cross bar 2 through slot 10. When locking device 11 is rotated, lock linkage 12 rotates and lifts hanger bar 13, connecting pin 14, and cross bar 2. Cross bar 2 is thereby raised from anchor 1 and the door is free to rotate. Returning locking device 11 to its original position will engage cross bar 2 into anchor 1. When cross bar 2 is disengaged from anchor 1, cross bar 2 will open parallel with the door as the door is opened.

From the foregoing it will be seen that this invention is well adapted to attain all the ends and objects herein set forth, together with other advantages which are obvious and inherent to the apparatus for preventing a door from opening.

It will be understood that certain features and subcombinations are utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as being illustrative and not in a limiting sense.

What is claimed is:

1. An apparatus for preventing a door from opening, comprising:

at least one anchor fixedly attachable to a floor on a side of a door toward which the door can be opened, the anchor having a planar base plate parallel to the floor and perpendicular to the door and at least one keeper plate extending perpendicularly from the base plate; and a cross bar rotatably attachable to the keeper plate.

2. The apparatus of claim 1 wherein the anchor which is nearest the hinged edge of the door is connected to said cross bar by a pin extending through the cross bar and through the keeper plate of said anchor so that the cross bar may be rotated upwardly to a storage position outside of the pathway of the door.

3. The apparatus of claim 1 wherein two or more anchors are connected to said cross bar by respective pins extending through the cross bar and through the keeper plate of said anchors, the anchor located nearest the hinged edge of the door containing a pin so that the cross bar may be rotated outside of the pathway of the door, and the other anchor containing a removable pin.

4. The apparatus of claim 1 wherein the base plate is circular and the keeper plate is rectangular.

5. The apparatus of claim 1 wherein said base plate is connectable to the floor by use of bolts or screws which pass through the base plate.

6. The apparatus of claim 1 wherein said anchor is connected to the floor by embedding a part of the anchor into the flooring material.

7. The apparatus of claim 1 further comprising anchors being set approximately three inches behind the door.

8. An apparatus for preventing a door from opening, comprising:

a pair of anchors, each including a planar base plate parallel to a floor and perpendicular to the door for connecting said anchors to the floor on opposing sides of an opening defined by the door on the side of the door toward which the door can be opened, and two or more keeper plates extending perpendicularly from the base plate and spaced apart from one another to form a slot therebetween, said anchors being oriented such that the slots are aligned with one another; and a cross bar for positioning in the aligned slots in said anchors of a length greater than the width of the door.

9. The apparatus of claim 8 wherein the anchor which is nearest the edge of the door which is on the same edge of the door as the hinge of the door is connected to said cross bar by a pin extending through the cross bar and through the keeper plates of the said anchor so that the cross bar may be rotated upwardly to a storage position outside of the pathway of the door.

10. The apparatus of claim 8 wherein both anchors are connected to said cross bar by respective pins extending through the cross bar and through the keeper plates of the said anchors, the anchor located nearest the edge of the door which is on the same edge of the door as the hinge of the door containing a pin so that the cross bar may be rotated upwardly to a storage position outside of the pathway of the door, and the anchor located on the opposite edge of the door containing a removable pin in order to fix the cross bar in a down and locked position when the pin is engaged, or releasing the cross bar when the pin is removed.

11. The apparatus of claim 8 wherein the base plates are circular and the keeper plates are rectangular.

12. The apparatus of claim 8 wherein said base plates are connected to the floor by use of bolts or screws which pass through the base plates and whose heads are counter sunk to be flush with the top of the base plates.

13. The apparatus of claim 8 wherein said base plates are connected to the floor by embedding each base plate into the flooring material.

14. The apparatus of claim 8 further comprising anchors being set approximately three inches behind the door in order for the apparatus to be used as a safety stop that prevents the door from being opened completely, but allows the door to be opened enough for the person inside to look out of the opening.

15. An apparatus for preventing a door from opening, comprising:

an anchor including a planar base plate parallel to a floor and perpendicular to the door for connecting said anchor to the floor beyond the edge of an opening defined by the door and beyond the edge of the door opposite from the hinge of the door and on a side of the door toward which the door can be opened, at least two keeper plates extending perpendicularly and vertically from the base plate and spaced apart from one another to form a slot therebetween, said anchor being oriented such that the slot is parallel with the door when in the closed position;

an anchor including a planar base plate parallel to the floor and perpendicular to the door for rotatably connecting said anchor to the floor beyond the edge of an opening defined by the door and beyond the edge of the door nearest to the hinge of the door and on a side of the door toward which the door can be opened, and keeper plates extending perpendicularly and vertically from the base plate and spaced apart from one another to form a slot therebetween;

a cross bar having a slot parallel to the longitudinal axis of the cross bar and for positioning in the slots in said anchors and which connects to the anchor which is nearest the edge of the door which is on the same edge of the door as the hinge of the door by a pin extending through the cross bar and through the keeper plates of the said anchor so that the cross bar may be rotated upwardly, and which is of a length greater than the width of the door;

a connecting pin providing a means for slidably engaging the slot in the cross bar;

a hanger bar providing a means for fixedly connecting to the connecting pin;

a lock linkage providing a means for rotatably connecting to the hanger bar; and a locking device extending through the door and providing a means to rotate a lock mechanism within the locking device from either inside or outside of the door, the locking device being fixedly connected to the lock linkage.

16. The apparatus of claim 15 wherein both anchors are connected to said cross bar by respective pins extending through the cross bar and through the keeper plates of the said anchors, the anchor located nearest the edge of the door which is on the same edge of the door as the hinge of the door containing a pin so that the cross bar may be rotated upwardly, and the anchor located on the opposite edge of the door containing a removable pin in order to fix the cross bar in a down and locked position when the pin is engaged, or releasing the cross bar when the pin is removed.

17. The apparatus of claim 15 wherein the base plates are circular and the keeper plates are rectangular.

18. The apparatus of claim 15 wherein said base plates are connected to the floor by use of bolts or screws which pass through the base plates and whose heads are counter sunk to be flush with the top of the base plates.

19. The apparatus of claim 15 wherein said base plates are connected to the floor by embedding into the flooring material vertical elements which are connected to each base plate respectively.

20. An apparatus for preventing a door from opening, comprising:

at least one anchor having a planar base plate perpendicular to the door and parallel to and fixedly attachable to a floor on a side of a door toward which the door can be opened and including at least one keeper plate spaced apart from and fixedly connected to the base plate so as to form a slot parallel to the floor; and a cross bar rotatably attachable to the keeper plate.

21. An apparatus for preventing a door from opening, comprising:

two or more anchors, each including a planar base plate parallel to a floor and perpendicular to the door for connecting said anchors to the floor on opposing sides of an opening defined by the door on the side of the door toward which the door can be opened, and a keeper plate spaced apart from and fixedly connected to the base plate so as to form a slot parallel to the floor and base plate, said anchors being oriented such that the slots are aligned with one another; and a cross bar for positioning in the aligned slots in said anchors of a length greater than the width of the door.

22. An apparatus for preventing a door from opening, comprising:

an anchor including a planar base plate parallel to a floor and perpendicular to the door for connecting said anchor to the floor beyond the edge of an opening defined by the door and beyond the edge of the door opposite from the hinge of the door and on a side of the door toward which the door can be opened and a keeper plate spaced apart from and fixedly connected to the base plate so as to form a slot parallel to the floor and base plate, said anchor being oriented such that the slot is perpendicular with the door when in the closed position;

an anchor including a planar base plate parallel to the floor and perpendicular to the door for rotatably connecting said anchor to the floor beyond the edge of an opening defined by the door and beyond the edge of the door nearest to the hinge of the door and on a side of the door toward which the door can be opened, and a keeper plate spaced apart from the base plate and fixedly connected to the base plate so as to form a slot parallel to the floor and base plate, said anchor being oriented such that the slot is perpendicular with the door when in the closed position; and a cross bar for positioning in the aligned slots in said anchors of a length greater than the width of the door.

23. An apparatus for preventing a door from opening, comprising:

a first anchor including a planar base plate for parallel to a floor and perpendicular to the door connecting said anchor to the floor beyond the edge of an opening defined by the door and beyond the edge of the door opposite from the hinge of the door and on a side of the door toward which the door can be opened and a single keeper plate connected to but spaced apart from the base plate, said keeper plate being parallel to the base plate such that a slot is formed between the base plate and the keeper plate and perpendicular to the opening of the door;

a second anchor including a planar base plate parallel to the floor and perpendicular to the door for rotatably connecting said anchor to the floor beyond the edge of an opening defined by the door and beyond the edge of the door nearest to the hinge of the door and on a side of the door toward which the door can be opened and a keeper plate spaced apart from and fixedly connected to the base plate so as to form a slot parallel to the floor and base plate, said anchor being oriented such that the slot is perpendicular with the opening of the door; and a cross bar fixedly attached to the second anchor and removably attachable to the first anchor.

24. An apparatus for preventing a door from opening, comprising:

at least two anchors, each including a planar base plate parallel to a floor and perpendicular to the door for connecting said anchors to the floor beyond the edges of an opening defined by the door and on a side of the door toward which the door can be opened and a single keeper plate connected to but spaced apart from the base plate, said keeper plate being parallel to the base plate such that a slot is formed between the base plate and the keeper plate and perpendicular to the opening of the door; and a cross bar insertable within said slots and attachable to said anchors by means of one or more pins.

25. A method of securing a door comprising:

rigidly attaching one or more anchors to a floor on the side of the door toward which the door can be opened and beyond the edges of an opening defined by the door, each anchor having a planar base plate parallel to the floor and perpendicular to the door and a keeper plate at least a portion of which is perpendicular to the base plate; and attaching a cross bar to the anchor in the path of the door.

* * * * *